US007270068B2

(12) United States Patent
Mizutani

(10) Patent No.: US 7,270,068 B2
(45) Date of Patent: Sep. 18, 2007

(54) STEERING CONTROL SYSTEM FOR BOAT

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 17 days.

(21) Appl. No.: 11/354,491

(22) Filed: Feb. 15, 2006

(65) Prior Publication Data

US 2006/0180070 A1 Aug. 17, 2006

(30) Foreign Application Priority Data

Feb. 15, 2005 (JP) ..... 2005-037241

(51) Int. Cl.
*B63H 25/00* (2006.01)
*B63H 25/04* (2006.01)
*B63H 21/175* (2006.01)

(52) U.S. Cl. ..... 114/144 RE; 114/144 R; 440/12

(58) Field of Classification Search ..... None
See application file for complete search history.

(56) References Cited

U.S. PATENT DOCUMENTS

| | | | |
|---|---|---|---|
| 2,215,003 | A | 9/1940 | Johnson |
| 2,224,357 | A | 12/1940 | Pecker |
| 3,084,657 | A | 4/1963 | Kiekhaefer |
| 3,233,691 | A | 2/1966 | De Biasi |
| 3,310,021 | A | 3/1967 | Shimanckas |
| 3,349,744 | A | 10/1967 | Mercier et al. |
| 4,120,258 | A | 10/1978 | Spurgin |
| 4,220,111 | A | 9/1980 | Krautkremer et al. |
| 4,500,298 | A | 2/1985 | Hall et al. |
| 4,519,335 | A | 5/1985 | Krautkremer et al. |
| 4,787,867 | A | 11/1988 | Takeuchi et al. |
| 4,872,857 | A | 10/1989 | Newman et al. |
| 4,908,766 | A | 3/1990 | Takeuchi |
| 4,909,765 | A | 3/1990 | Riske et al. |

(Continued)

FOREIGN PATENT DOCUMENTS

JP 62-166193 7/1987

(Continued)

OTHER PUBLICATIONS

Co-pending U.S. Appl. No. 11/384,616, filed Mar. 20, 2006. Title: Steering Control System for Boat.

(Continued)

*Primary Examiner*—Lars A. Olson
*Assistant Examiner*—Daniel V. Venne
(74) *Attorney, Agent, or Firm*—Knobbe, Martens, Olson & Bear LLP

(57) ABSTRACT

A rudder control device for a boat can include a handle position sensor for detecting an operation angle of a handle. An engine control unit can be provided for receiving a detection signal from the handle position sensor. A motor can be provided for receiving a control signal from the engine control unit to drive a steering member to a predetermined rotation angle corresponding to the operation angle. The engine control unit can receive a signal from a speed sensor for detecting a boat speed to control an upper limit of the rotation angle to be smaller when the boat speed is higher than a predetermined value than when not.

9 Claims, 7 Drawing Sheets

U.S. PATENT DOCUMENTS

| | | | | |
|---|---|---|---|---|
| 5,029,547 | A | 7/1991 | Novey | |
| 5,031,562 | A | 7/1991 | Nakase et al. | |
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,892,661 | B2 | 5/2005 | Kishi et al. | |
| 6,892,662 | B2 | 5/2005 | Watanabe et al. | |
| 6,994,046 | B2 * | 2/2006 | Kaji et al. | 114/144 R |
| 2003/0150368 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0170712 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 04-038297 | 2/1992 |
| JP | B-HEI 6-33077 | 5/1994 |
| JP | 2739208 B2 | 1/1998 |
| JP | 10/226346 | 8/1998 |
| JP | A-HEI 10-310074 | 11/1998 |
| JP | 2959044 B2 | 7/1999 |
| JP | 2000-318691 | 11/2000 |
| JP | 2003-313398 | 11/2000 |
| JP | 3232032 | 9/2001 |
| JP | A-2002-331948 | 11/2002 |
| JP | A-2004-155282 | 6/2004 |

OTHER PUBLICATIONS

Co-pending U.S. Appl. No. 11/089,929, filed Mar. 25, 2005. Now published as US2005-0215131A1 (submitted herewith). Title: Steering System of Outboard Motor.

Co-pending U.S. Appl. No. 11/075,131, filed Mar. 8, 2005. Now issued as US7,063,030 (submitted herewith). Title: Electric Steering Apparatus for Watercraft.

Co-pending U.S. Appl. No. 11/075,129, filed Mar. 8, 2005. Now published as US 2005-0199169A1 (submitted herewith). Title: Steering Assist System for Boat.

Co-pending U.S. Appl. No. 11/074,805, filed Mar. 8, 2005. Now published as US 2005-0199167A1 (submitted herewith). Title: Steering System for Boat.

Co-pending U.S. Appl. No. 11/155,757, filed Jun. 17, 2005. Now published as US 2005-02824474A1 (submitted herewith). Title: Steering Device for Small Watercraft).

Co-pending U.S. Appl. No. 11/047,098, filed Jan. 31, 2005. Now published as US 2005-0170712A1 (submitted herewith). Title: Method and System for Steering Watercraft.

Co-pending U.S. Appl. No. 11/047,123, filed Jan. 31, 2005. Now published as US 2005-0170713A1 (submitted herewith). Title: Method and System for Steering Watercraft.

Co-pending U.S. Appl. No. 11/588,060, filed Oct. 25, 2006. Inventor: Mizutani. (submitted herewith) Title: Control Unit for Multiple Installation of Propulsion Units.

Co-pending U.S. Appl. No. 11/515,600, filed Sep. 5, 2006. Inventor: Mizutani. (submitted herewith) Title: Steering System for a Small Boat.

Co-pending U.S. Appl. No. 11/516,151, filed Sep. 5, 2006. Inventor: Mizutani. (submitted herewith) Title: Steering Method and Steering System for Boat.

Co-pending U.S. Appl. No. 11/593,393, filed Nov. 6, 2006. Inventor: Mizutani. (submitted herewith) Title: Electric Type Steering Device for Outboard Motors.

Co-pending U.S. Appl. No. 11/507,399, filed Aug. 21, 2006. Now published as US2007-0049139A1. (submitted herewith). Title: Action Control Device for Small Boat.

Co-pending U.S. Appl. No. 11/029,667, filed Jan. 5, 2005. Now published as US2006-0019558A1 (submitted herewith). Title: Steering System for Outboard Drive.

* cited by examiner

STEERING CONTROL SYSTEM FOR BOAT

PRIORITY INFORMATION

The present application is based on and claims priority under 35 U.S.C. § 119(a-d) to Japanese Patent Application No. 2005-037241, filed on Feb. 15, 2005 the entire contents of which is expressly incorporated by reference herein.

BACKGROUND OF THE INVENTIONS

1. Field of the Inventions

The present inventions relate to steering control systems for boats including an electric steering drive system.

2. Description of the Related Art

A conventional electric steering control system for an outboard motor is described in Japanese Patent Document JP-B-2959044. In the device, the rotation or pivoting of a steering wheel or handle is detected by a sensor. The sensor sends a signal to a controller. Using this signal, the controller drives an electric motor which in turn, changes the steering angle of the outboard motor to thereby steer the boat in accordance with the movement of the steering wheel or handle. The controller is configured to change the steering angle of the outboard motor by a predetermined amount based on the detection of predetermined amounts of rotation or pivoting of the steering wheel or handle.

These types of electric steering systems have become more popular recently. One reason is that these types of systems do not have a direct mechanical connection between the steering wheel or handle and the steering member. Thus, the movement or feeling of the steering wheel or handle is light, regardless of the speed of the watercraft. As such, it is easy for an operator to turn the steering wheel or handle at any operating speed.

SUMMARY OF THE INVENTIONS

Problem to be Solved by the Inventions

In accordance with at least one of the embodiments disclosed herein, a steering system for a boat can include operation angle detection means for detecting an operation angle of a handle. Control means can be provided for receiving a detection signal from the operation angle detection means. Electric drive means can be provided for receiving a control signal from the control means to drive a steering member to a predetermined rotation angle corresponding to the operation angle. The control means can be provided to receive a signal from boat speed detection means for detecting a boat speed to control an upper limit of the rotation angle to be smaller when the boat speed is higher than a predetermined value than when not.

In accordance with another embodiment, a steering system can include operation angle detection means for detecting an operation angle of a handle. Control means can be provided for receiving a detection signal from the operation angle detection means. Drive means can be provided for receiving a control signal from the control means to drive a steering member to a predetermined rotation angle corresponding to the operation angle. The control means can be provided for receiving a signal from boat speed detection means for detecting a boat speed to control a change rate of the rotation angle to the operation angle to be smaller when the boat speed is higher than a predetermined value than when not.

In accordance with yet another embodiment a steering system can be provide for a boat. The steering system can comprising a steering command sensor configured to detect steering commands from an operator of the boat and to output a steering command signal. A control device can be configured to receive the steering command signal from the steering command sensor and to output a control signal. An electric drive device can be configured to receive the control signal from the control device to drive a steering member to a predetermined rotation angle corresponding to the steering command. A boat speed detection device can be configured to detect a speed of the boat, and a steering member can be configured to control a direction of travel of the boat. The control device is configured to allow the steering member to be moved through its full range of movement when the boat speed is below a first predetermined angle, and to limit the proportion of movement of the steering member to magnitude of the steering command when the boat speed is higher than a first predetermined value.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
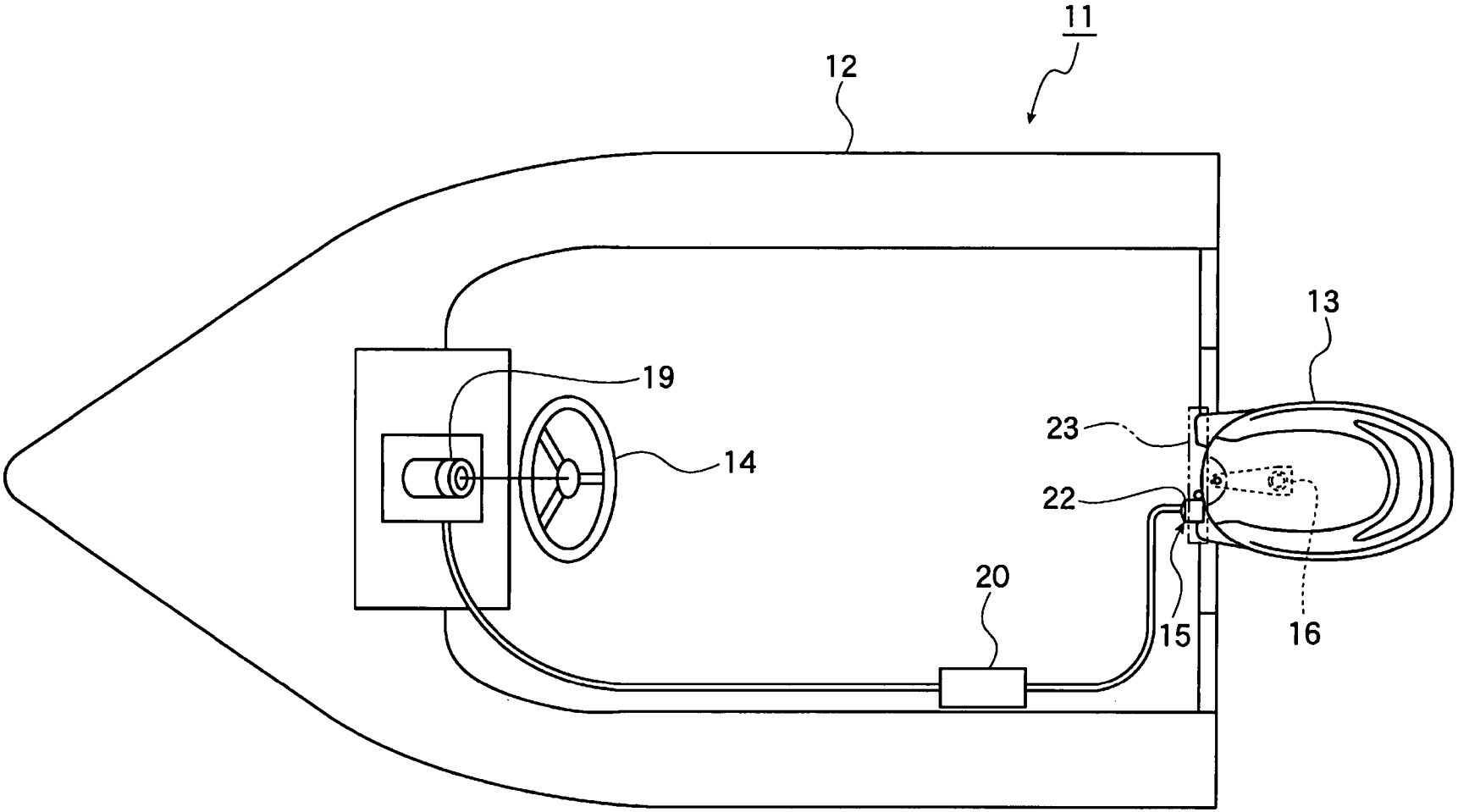
FIG. 1 is a schematic plan view showing a small boat having a steering control system in accordance with an embodiment.

In FIG. 1, reference numeral 11 denotes a small boat having a hull 12 and an outboard motor 13 provided at the rear part of the hull 12 for free rotation. The embodiments disclosed herein are described in the context of a small watercraft having multiple at least one outboard because the embodiments disclosed herein have particular utility in this context. However, the embodiments and inventions herein can also be applied to other boats having other types of propulsion units as well as other types of vehicles.

As used herein, the terms "front," "rear," "left," "right," "up" and "down," correspond to the direction assumed by a driver of the watercraft.

The boat 11 can include an outboard motor 13 configured to provide a propulsion force to the hauled 12 for moving the boat 11 through the water. However, the boat 11 can any type of propulsion device.

A handle 14 can be provided in the front part of the hull 12 of the small boat 11. The handle 14 can be configured to operate as a steering input device so that an operator of the boat 11 can input steering commands. The handle 14 can be in the form of a steering wheel (as illustrated), a lever, or any other device.

A steering control system 15 is configured to control the direction of movement of the boat 11 based on commands into the handle 14 by an operator. In some embodiments, the steering control system 15 can be configured to control and orientation of the outboard motor 13. In such embodiments, the outboard motor 13 can be mounted to pivot about a swill shaft 16. For example, the control system 15 can be configured to pivot or rotate the outboard motor 13 about swivel shaft 16 in accordance with one or more predetermined relationships to the commands input into the handle 14 by an operator.

Figure 2:
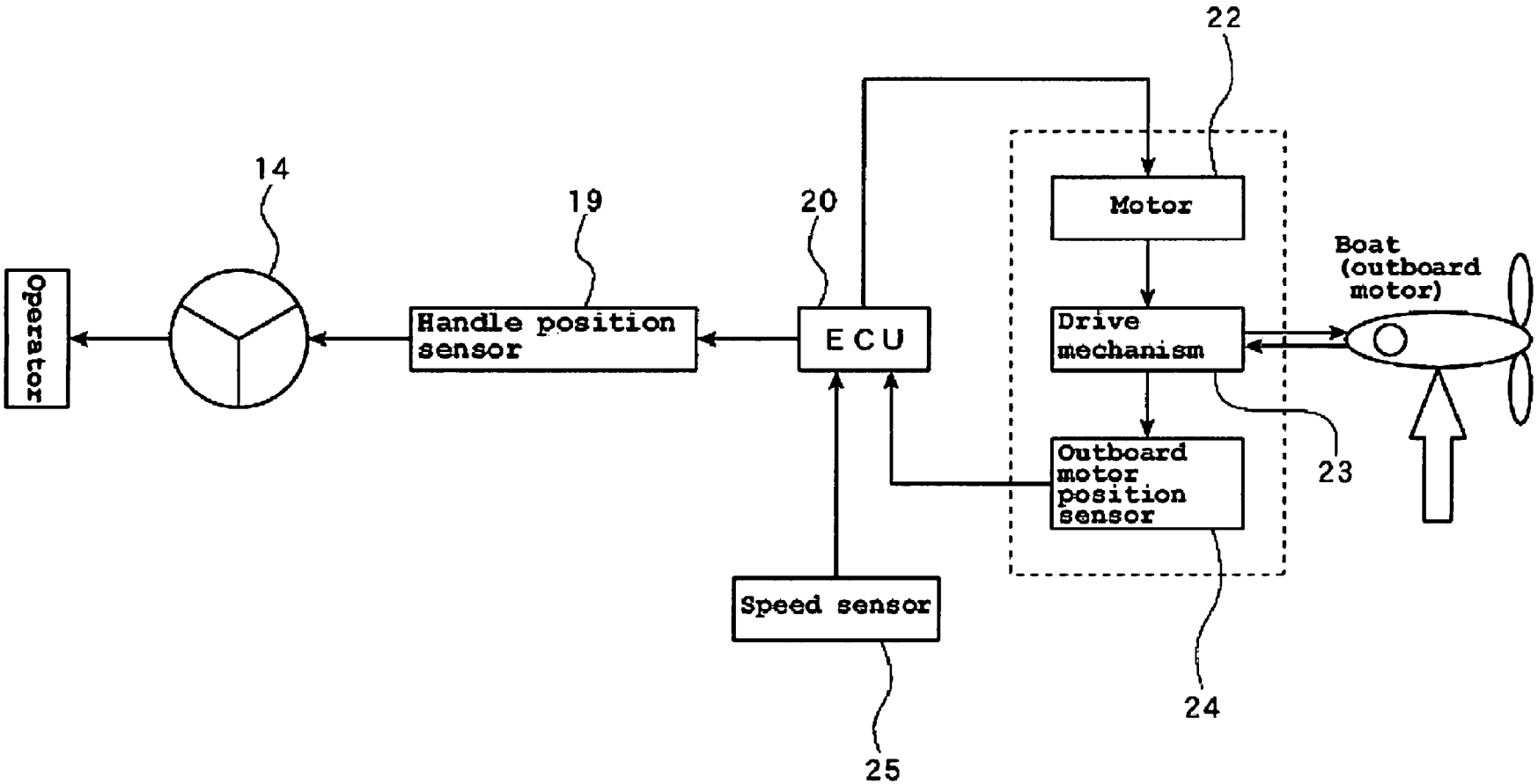
FIG. 2 is a block diagram of the steering control system.
Figure 3:
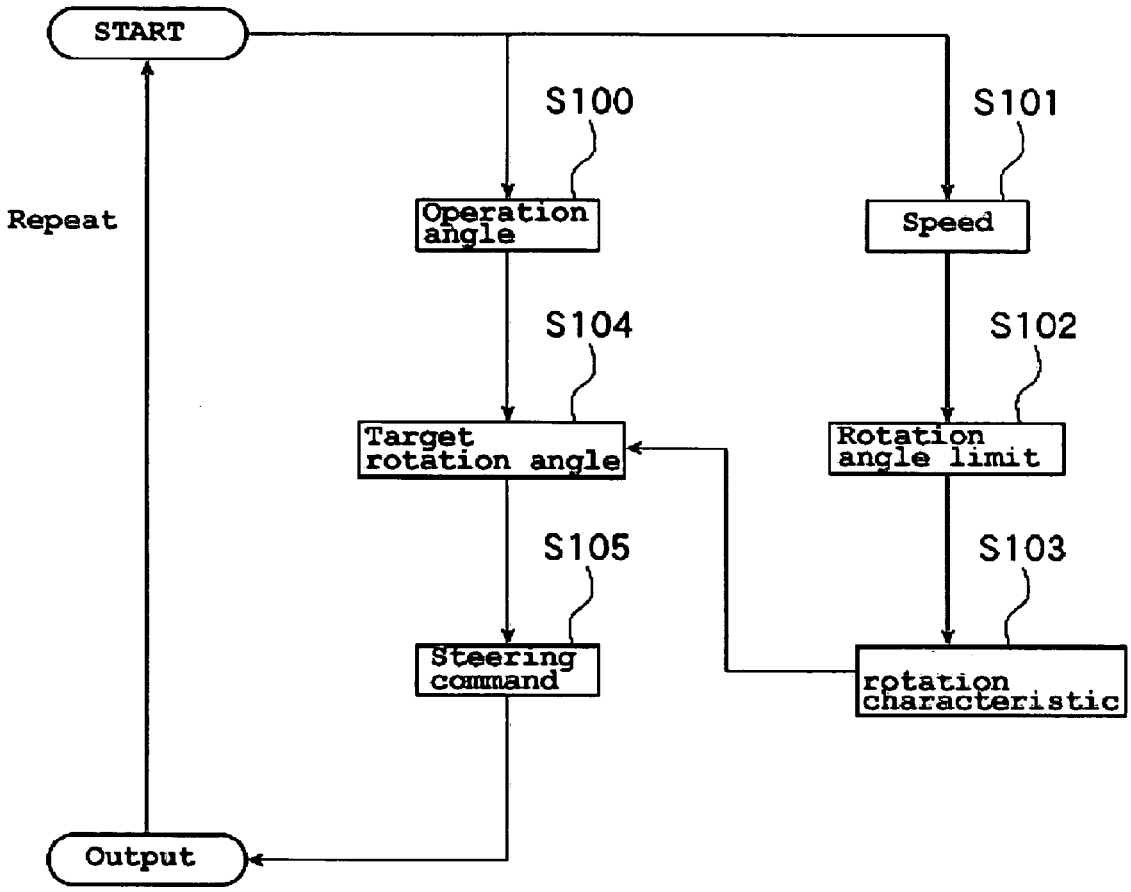
FIG. 3 is a flowchart of illustrating an exemplary method of operation of the steering control system that can be used with the steering control system of FIGS. 1 and 2.

For example, as shown in FIGS. 1 and 2, the handle 14 can be provided with a handle position sensor 19 configured to detect an operation angle of the handle 14. Thus, in some embodiments, the handle position sensor 19 can operate as an "operation angle detection means." The sensor 19 can be configured to output a detection signal to an engine control unit (hereinafter referred to as "ECU") 20. In some embodiments, the ECU 20 can function as a "control means."

The ECU 20 can be configured to compute a value for the target rotation angle corresponding to the detected value of the steering command detected by the sensor 19. The ECU 20 can also be configured to output a position command signal corresponding to the target rotation angle.

The position command signal can be input to a motor 22 of the steering control system 15. Thus, in some embodiments, the motor 22 function as a "drive means." In response to the position command signal, the motor 22 can rotate the outboard motor 13 through a drive mechanism 23. In some embodiments, the motor 22 can be configured to rotate the outboard motor 13 through a predetermined angle for a given position command signal. Additionally, in some embodiments, the motor 22 can be configured to drive a drive mechanism 23, which in turn, is configured to rotate the outboard motor 13 about the swivel shaft 16.

The steering system 15 can also include a steering member position sensor 24 configured to detect the position of a steering member, which in some embodiments, is the outboard motor 13 itself. The sensor 24 can b configured to output a signal indicative of the rotational position of the outboard motor 13. The ECU 20 can use this signal as feedback information to maintain the outboard motor 13 in the target position. Additionally, the steering system 15 can include a boat speed sensor 25 configured to detect a speed of the boat 11 and to provide the ECU 20 with a signal indicative of the boat speed. As such, the boat speed sensor can serve as as "boat speed detection means".

Figure 4:
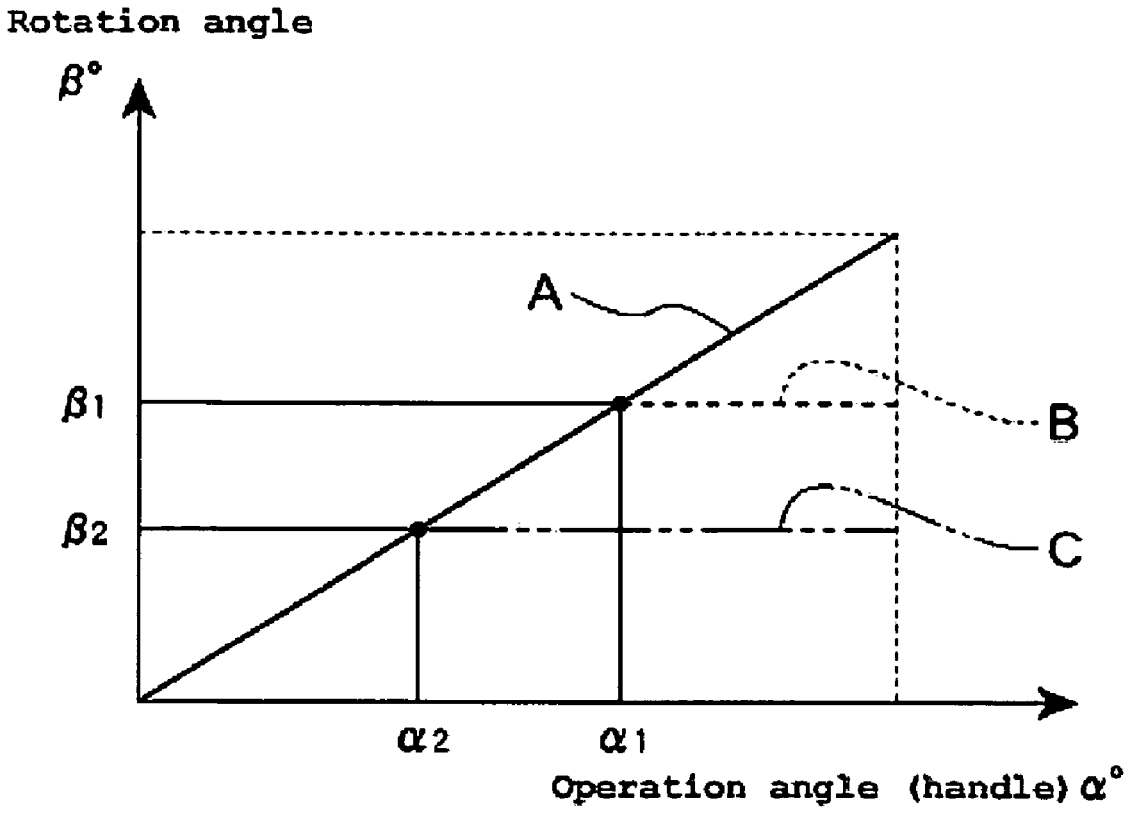
FIG. 4 illustrates an exemplary relationship between a steering input member position and steering position of the outboard motor resulting from the operation of the steering control system.

The ECU 20 can be configured to control the motor 22 according to the signal from the speed sensor 25, such that the rotation angle or steering angle of the outboard motor 13 is smaller when the boat speed is higher than a predetermined value than when not. In other words, the steering system can operate in one or more different, modes depending on boat speed, wherein in one mode, the steering system defines a first proportional relationship between the detected operation angle of the handle 14 and the steering angle of the outboard motor 13 and in a second mode the system defines a second proportional relationship. As used herein, the term proportional relationship is not intended to require any particular relationship. Further, such proportional relationships are not required to be continuously smooth. Rather, such proportional relationships can be stepped, discontinuous, linear, non-linear, or smooth. FIG. 4 illustrated one exemplary relationship that can be used. However, other relationships can also be used.

That is, when the speed of the boat 11 is a predetermined speed or lower, the ECU 20 controls the steering position of the outboard motor 13 according to the characteristic line A (a generally constant, proportional relationship) indicated by the solid line in FIG. 4. When the boat speed is higher than the first predetermined value, the upper limit of the rotation angle is set to β1, and when the boat speed is further higher (e.g., higher than a second predetermined value), the upper limit is set to β2 (which is smaller than the value β1). As such, the outboard motor 13 cannot be turned to a steering position more severe than β1 when the speed of the boat 11 is between the first and second predetermined values. Further, the outboard motor 13 cannot be turned to a steering position more severe than β2 when the boat speed is above the second predetermined value.

An exemplary but non-limiting method for operating the steering system 15 is described below with reference to FIG. 4. However, it is to be understood that the method described with reference to FIG. 4 is merely one example of a method that can be used. Other methods can also be used.

With the steering system 15 operating under the method of FIG. 4, when a boat operator operates the handle 14, the handle position sensor 19 detects an operation angle (handle angle) a° in step S100. The speed sensor 25 detects the speed of the small boat 11 in step S101. Both values can be input to the ECU 20.

According to the boat speed, the ECU 20 determines a rotation angle limit based on the rotation characteristic map shown in FIG. 4 in step S102. The rotation angle limit is set to the value β1 when the boat speed is higher than a first predetermined value, and when the boat speed is further higher than that, e.g., higher than a second predetermined value, the rotation angle limit is set to the value β2, which can be smaller than the value β1. When the boat speed is the first predetermined value or lower, the rotation angle is controlled according to the characteristic line A, e.g., the steering control system 15 can turn the outboard motor 13 through the full range of movement and can be in a generally linear proportional relationship.

Then, in step S103, a characteristic line A, B, or C is selected from the rotation characteristic map, based on the determined rotation angle limit.

Then, a target rotation angle β° is determined from the current rotation angle based on the rotation characteristic map in step S104, and a steering command corresponding to the target rotation angle β° is sent to the motor 22 in step S105. The motor 22 operates according to the command value to rotate the outboard motor 13 in a predetermined direction by a predetermined amount via the drive mechanism 23. At this time, the rotation angle of the outboard motor 13 is fed back from the outboard motor position sensor 24 to the ECU 20, which performs feedback control when the actual and target rotation angles do not coincide with each other.

As described above, when the boat speed is a predetermined value or lower, control is performed according to the characteristic line A, which with its large maximum rotation angle can give large angles to the outboard motor 13.

Also, when the boat speed has become higher than the predetermined value and hence the rotation angle limit is now set to the value β1, the rotation angle follows the characteristic line B. That is, the rotation angle does not exceed but is constant at the value β1, even if the operation angle exceeded the value a1. Therefore, the boat running at a higher speed does not turn at as severe an angle even when the handle 14 is turned to its maximum position.

In addition, when the boat speed has become further higher than the predetermined value and hence the rotation angle limit is now set to the value β2, the rotation angle follows the characteristic line C. That is, the rotation angle does not exceed but is constant at the value β2 even if the operation angle exceeded the value a2. Therefore, the boat running at a further higher speed can only turn at an angle that is less severe than the angle defined by characteristic line B, even if the handle 14 is turned to its maximum position.

Figure 5:
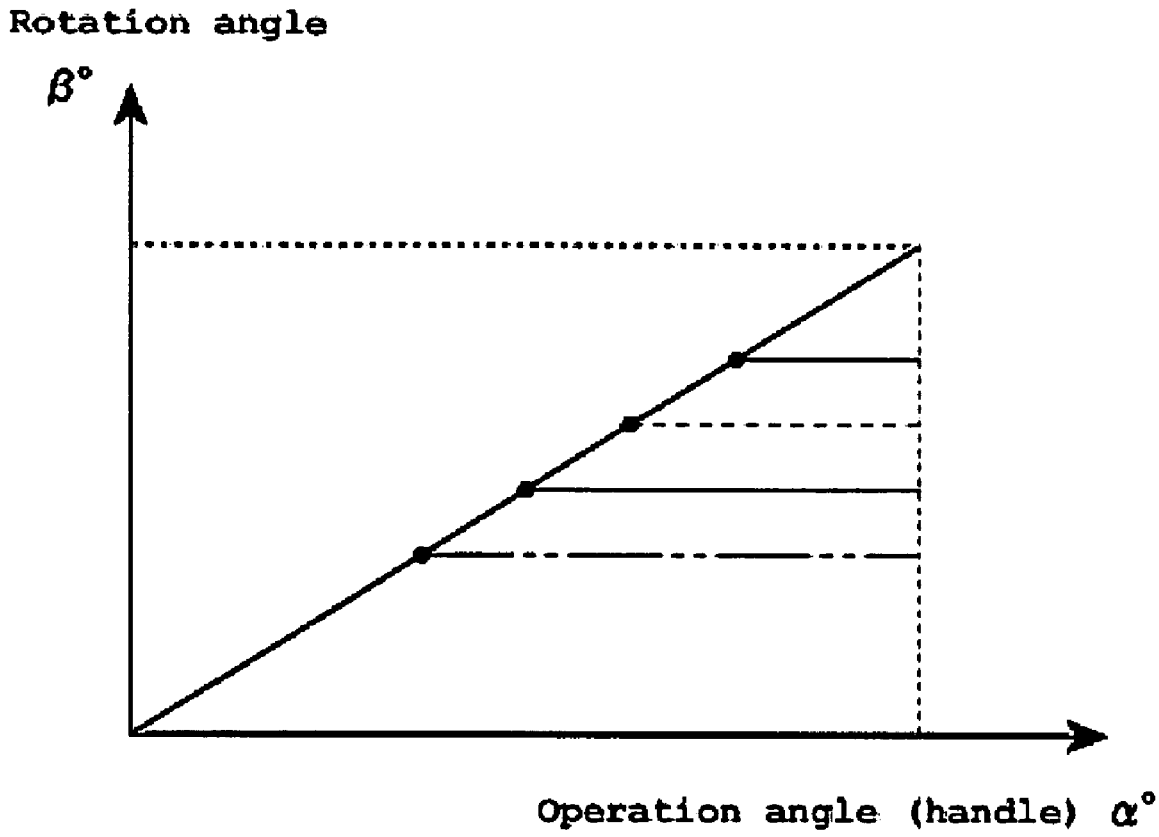
FIG. 5 illustrates another exemplary relationship between the steering input member position and the steering position of the outboard motor resulting from the operation of the steering control system.

Two rotation angle limits are set in this embodiment. However, it should be understood that the present invention is not limited thereto, but four or another number of rotation angle limits may be set instead, for example, as shown in FIG. 5.

Figure 6:
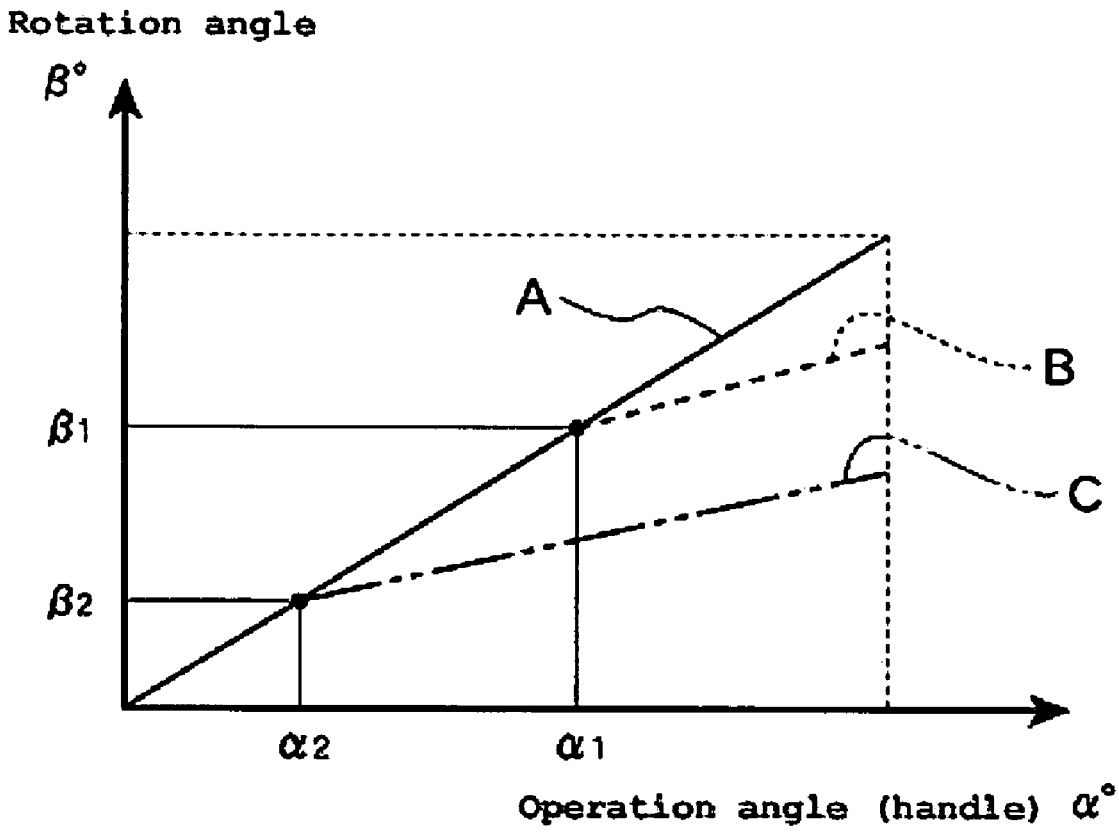
FIG. 6 illustrates yet another exemplary relationship between the steering input member position and the steering position of the outboard motor resulting from the operation of the steering control system.

FIG. 6 shows of modification of the rotation angle characteristic map of FIG. 4. In the non-limiting embodiment of FIG. 6, the rotation characteristic map defines changes in the proportion relationship of the rotation angle to the operation angle to be smaller when the boat speed is higher than a predetermined value than when not.

Specifically, when the boat speed is a predetermined value or lower, control is performed according to the characteristic line A (given proportional relationship) indicated by the solid line in the drawing. When the boat speed is higher than the predetermined value, control is performed according to the characteristic line B indicated by the broken line, in the range where the value for the rotation angle is larger than the value β1. In some embodiments, the characteristic B can also be generally proportional to the angle at which the handle 14 is turned, however, with a smaller magnitude slope (where the slope is defined as (change in rotation angle)/(change in handle angle)). When the boat speed is further higher, control is performed according to the characteristic line C indicated by the chain double-dashed line, in the range where the value for the rotation angle is larger than the value β2 (which is smaller than the value β1). As illustrated in FIG. 6, the slope of the characteristic line C has about the same slope as line B. However, the slope of line C can be less than the slope of line B.

In short, the change rate of the rotation angle to the operation angle is set to be smaller when the boat speed is higher than a predetermined value as indicated by the characteristic line B or C, than when not as indicated by the characteristic line A.

Thus, when the boat speed is a predetermined value or lower, control is performed according to the characteristic line A, which allows the outboard motor 13 to be rotated through its largest range of motion.

Also, when the boat speed is higher than the predetermined value and hence a characteristic map according to the characteristic line B is selected in the range where the value for the rotation angle is larger than the value β1, and when the operation angle is larger than the value a1, the target rotation angle is determined according to the characteristic line B and used to steer the boat.

Thus, since the change rate of the rotation angle to the operation angle is smaller, the outboard motor 13 rotates gently even when the handle 14 is operated quickly, which can thus prevent the boat from being steered abruptly. However, a steep turn is also possible by quick operation of the handle 14.

In addition, when the boat speed is further higher and hence a characteristic map according to the characteristic line C is selected in the range where the value for the rotation angle is larger than the value β1, and when the operation angle is larger than the value a2 (which is smaller than the value a1), the target rotation angle is determined according to the characteristic line C and used to steer the boat.

Thus, the outboard motor 13 rotates gently even where the operation angle is much smaller, thereby achieving suitable control in accordance with the boat speed.

Figure 7:
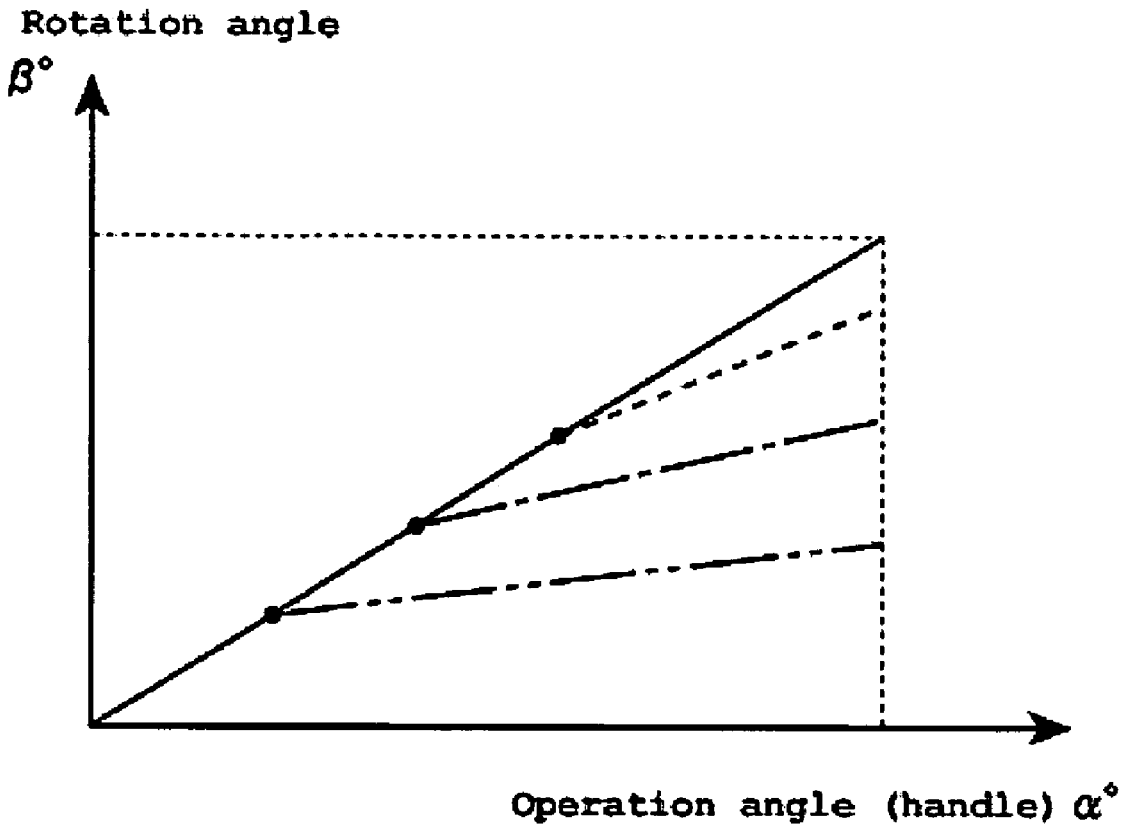
FIG. 7 illustrates a further exemplary relationship between the steering input member position and the steering position of the outboard motor resulting from the operation of the steering control system.

Two characteristic lines (B and C) are used in the embodiment of FIG. 6. However, the present inventions are not limited thereto, but three or more characteristic lines may be used, for example, and also the inclinations of the characteristic lines may be different from each other, as shown in FIG. 7. Further, as shown in FIG. 7, the characteristic lines can other slopes. In the non-limiting embodiment of FIG. 7, each characteristic line has its won slope, i.e., the slope of each line is different.

In the above embodiments, the motor 22 is used to rotate the outboard motor 13. However, the present inventions are not limited thereto, but hydraulic or other means may be used. Also, the steering member can be an outboard portion of the inboard-outboard motor or the like, instead of the outboard motor 13.

What is claimed is:

1. A steering system for a boat, comprising:

operation angle detection means for detecting an operation angle of a handle;

control means for receiving a detection signal from the operation angle detection means; and electric drive means for receiving a control signal from the control means to drive a steering member to a predetermined rotation angle corresponding to the operation angle, wherein the control means receives a signal from a boat speed detection means for detecting a boat speed to control an upper limit of the rotation angle to be smaller when the boat speed is higher than a predetermined value than when not.

2. A steering system for a boat, comprising:

operation angle detecton means for detecting an operation angle of a handle;

control means for receiving a detection signal from the operation angle detection means; and drive means for receiving a control signal from the control means to drive a steering member to a predetermined rotation angle corresponding to the operation angle, wherein the control means receives a signal from a boat speed detection means for detecting a boat speed to control a change rate of the rotation angle to the operation angle to be smaller when the boat speed is higher than a predetermined value than when not.

3. A steering system for a boat comprising a steering command sensor configured to detect steering commands from an operator of the boat and to output a steering command signal, a control device configured to receive the steering command signal from the steering command sensor and to output a control signal, an electric drive device configured to receive the control signal from the control device to drive a steering member to a predetermined rotation angle corresponding to the steering command, a boat speed detection device configured to detect a speed of the boat, and a steering member configured to control a direction of travel of the boat, wherein the control device is configured to allow the steering member to be moved through its full range of movement when the boat speed is below a first predetermined angle, and to limit the proportion of movement of the steering member to a magnitude of the steering command signal when the boat speed is higher than a first predetermined value.

4. The steering system according to claim 3, wherein the steering member is an outboard motor.

5. The steering system according to claim 3, wherein the control device is configured to limit the movement of the steering member to a first limited maximum steering angle when the speed of the boat is higher than the first predetermined value.

6. The steering system according to claim 4, wherein the control device is configured to limit the movement of the steering member to a first limited maximum steering angle when the speed of the boat is higher than the first predetermined value.

7. The steering system according to claim 6, wherein the control device is configured to limit the movement of the steering member to a second limited maximum steering angle when the speed of the boat is higher than a second predetermined value, the second limited maximum steering angle is smaller than the first limited maximum steering angle, and the second predetermined value being greater then the first predetermined value.

8. The steering system according to claim 3, wherein the control device is configured to limit the movement of the steering member to a first limited maximum proportional relationship having a first magnitude of a proportion of steering member movement to steering command magnitude when the speed of the boat is higher than the first predetermined value.

9. The steering system according to claim 3, wherein the control device is configured to limit the movement of the steering member to a second limited maximum proportional relationship having a second magnitude of a proportion of steering member movement to steering command magnitude when the speed of the boat is higher than the second predetermined value.

* * * * *